United States Patent [19]

Song

[11] 4,316,477

[45] Feb. 23, 1982

[54] WASHING MACHINE FOR DISHES

[76] Inventor: Hu-Kuo Song, 24, Alley 3, Lane 100, Ta Ya Rd., Taichung City, Taiwan

[21] Appl. No.: 176,505

[22] Filed: Aug. 8, 1980

[51] Int. Cl.[3] ..... B08B 3/02

[52] U.S. Cl. ..... 134/96; 134/112; 134/153

[58] Field of Search ..... 134/96, 103, 112, 153

[56] References Cited

U.S. PATENT DOCUMENTS

| | | | |
|---|---|---|---|
| 1,825,095 | 9/1931 | Schneider | 134/112 |
| 2,226,096 | 12/1940 | Halsey | 134/96 X |
| 3,006,351 | 10/1961 | Grube | 134/112 |
| 3,166,082 | 1/1965 | Arnold et al. | 134/153 X |
| 3,229,701 | 1/1966 | Sadwith | 134/153 X |
| 3,460,550 | 8/1969 | Zanussi | 134/112 |
| 3,587,597 | 6/1971 | Courtney et al. | 134/96 X |

FOREIGN PATENT DOCUMENTS

| | | | |
|---|---|---|---|
| 535479 | 10/1931 | Fed. Rep. of Germany | 134/103 |

*Primary Examiner*—Robert L. Bleutge

*Attorney, Agent, or Firm*—Roylance, Abrams, Berdo & Farley

[57] ABSTRACT

A washing machine comprises a casing body having a washing compartment therein, replaceable baskets rotatably supported in the washing compartment, a driving motor provided in the casing body, transmission gear sets engaged with the driving motor to rotate the baskets, tanks connected with a number of injection pipes for storing water and rinsing liquid, and a pump for pressuring the water or the rinsing liquid to be injected out of the injection pipes onto dishes placed in the baskets.

10 Claims, 21 Drawing Figures

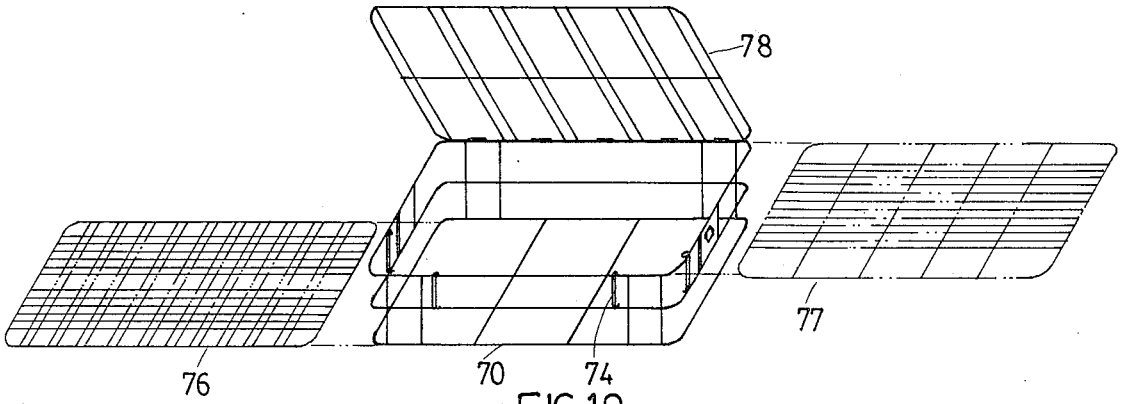
FIG.10a
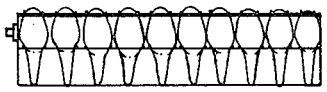
FIG.10c
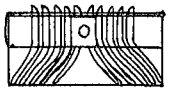
FIG.10b
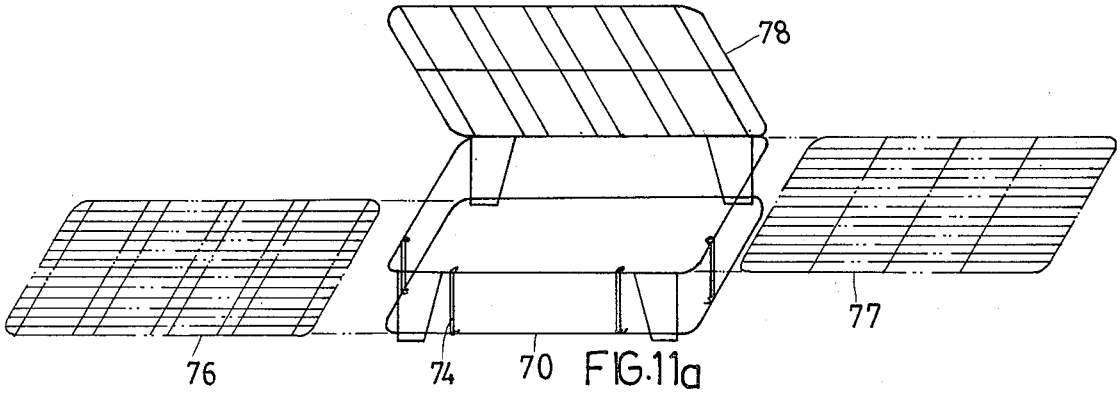
FIG.11a
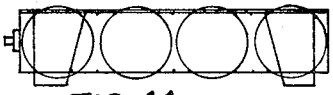
FIG.11c
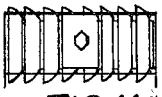
FIG.11b
FIG.12b
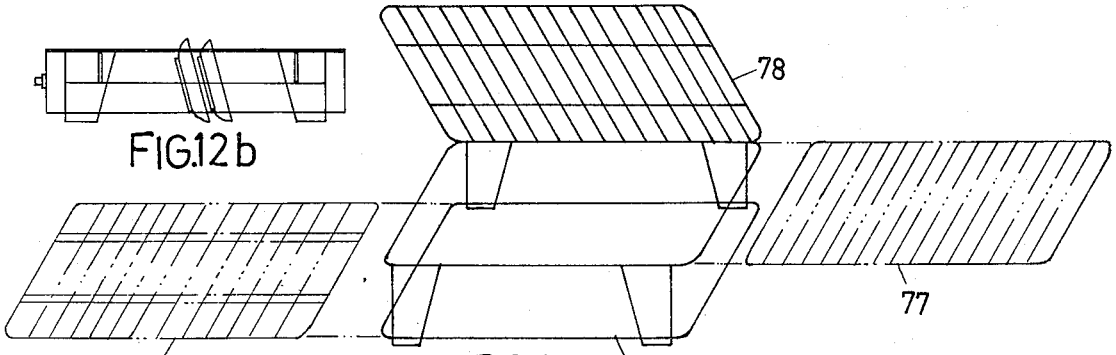
FIG.12a
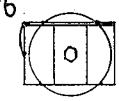
FIG.12c
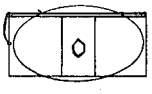
FIG.13

WASHING MACHINE FOR DISHES

BACKGROUND OF THE INVENTION

This invention relates to an apparatus for washing dishes, and more particularly, to an apparatus for washing small articles, such as spoons and chopsticks, and chinaware dishes.

Many washing machines are known in the art. Most of them have a large volume and however, a relative smaller capacity. Furthermore, they are only suitable for washing flat dishes made of plastics or stainless steel rather than smaller articles, such as spoons and chopsticks, and the chinaware dishes. In addition, to complete a whole washing operation, they need a considerable long time.

SUMMARY OF THE INVENTION

In accordance with the present invention, a washing machine which can overcome the above described drawbacks of the conventional washing machines is provided.

Accordingly, it is an important object of the present invention to provide a compact washing machine having a larger capacity per unit time. For instance, an embodiment of the present invention, which has a 132 cm×85 cm×88 cm volume, can wash 270 spoons one time, or 60 china bowls one time, or 48 round dishes having a diameter of 15 cm one time. The whole washing operation can be completed within five minutes.

It is a further object of the present invention to provide a washing machine which can be easily operated to perform flushing, rinsing and cleaning steps.

It is another object of the present invention to provide a washing machine having a considerable high efficiency.

These and other objects, features and advantages of the invention will be more apparent upon reading the following detailed specification and drawings, in which:

BRIEF DESCRIPTION OF THE DRAWINGS

FIG. 10*a* is an exploded perspective view of another basket;

FIG. 10*b* is a side view of the basket shown in FIG. 10*a* in which spoons are held serially;

FIG. 10*c* is a front view of the basket shown in FIG. 10*b;*

FIG. 11*a* is an exploded perspective view of the other basket;

FIG. 11*b* is a side view of the basket shown in FIG. 11*a* in which many round dishes are held serially;

FIG. 11*c* is a front view of the basket shown in FIG. 11*b;*

FIG. 12*a* is an exploded perspective view of a still further basket;

FIG. 12*b* is an exploded perspective view of the basket shown in FIG. 12*a* in which some larger round dishes are held;

FIG. 12*c* is a front view of the basket shown in FIG. 12*b;* and

FIG. 13 is a side view of the basket shown in FIG. 12*a* in which some elliptic dishes are held.

DETAILED DESCRIPTION OF THE PRESENT INVENTION

Figure 1:
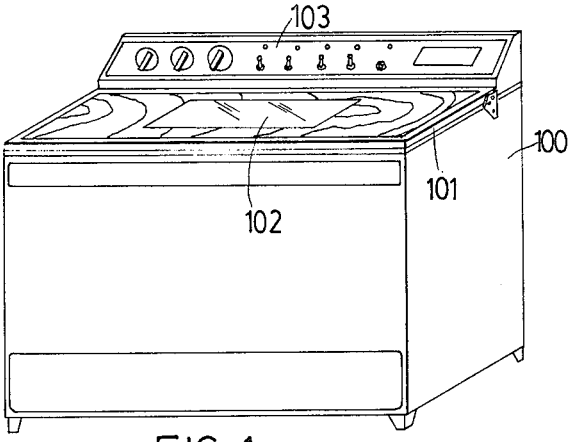
FIG. 1 is a perspective view of an embodiment of the present invention.

Referring to FIG. 1, there is shown an embodiment of the invention comprising a casing body 100, a cover 101 with a transparent window 102 mounted on the upper portion of the casing body 100, a washing compartment 105 (not shown in FIG. 1) within the casing body 100, and a panel 103 having a plurality of switches thereon.

Figure 2:
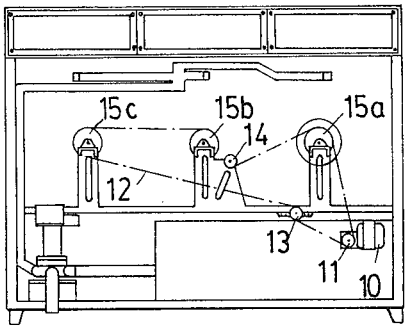
FIG. 2 is a rear view of said embodiment without a rear covering plate so as to illustrate a transmission mechanism provided therein.

FIG. 2 shows a rear view of the embodiment illustrating a transmission mechanism provided therein which includes a reversible motor 10 with a reduction gear 11 mounted on the frame of the casing body 100, three transmission gear sets 15*a*, 15*b* and 15*c*, an idling gear 14 located near the transmission gear set 15*b*, an adjusting gear 13 and a chain 12. A suitable tension force from the chain 12 can be gained by operating the adjusting gear 13. Through the chain 12 and the reduction gear 11, the three transmission gear sets 15*a*, 15*b* and 15*c* will be synchronously rotated in a desired speed by the motor 10.

Figure 9C:
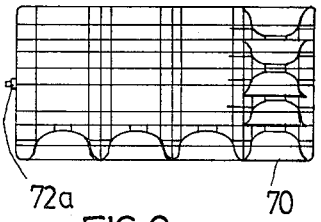
FIG. 9*c* is a front view of the basket shown in FIG. 9*b;*
Figure 9B:
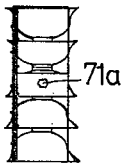
FIG. 9*b* is a side view of the basket in which bowls are held.
Figure 8:
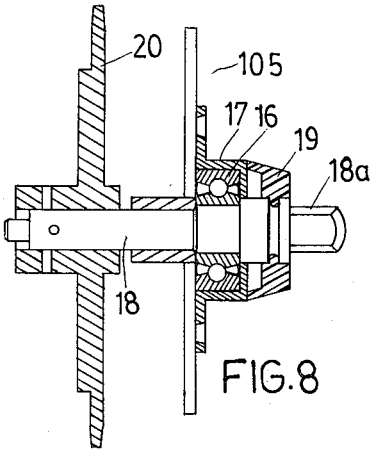
FIG. 8 is a sectional view of a transmission gear set.
Figure 9A:
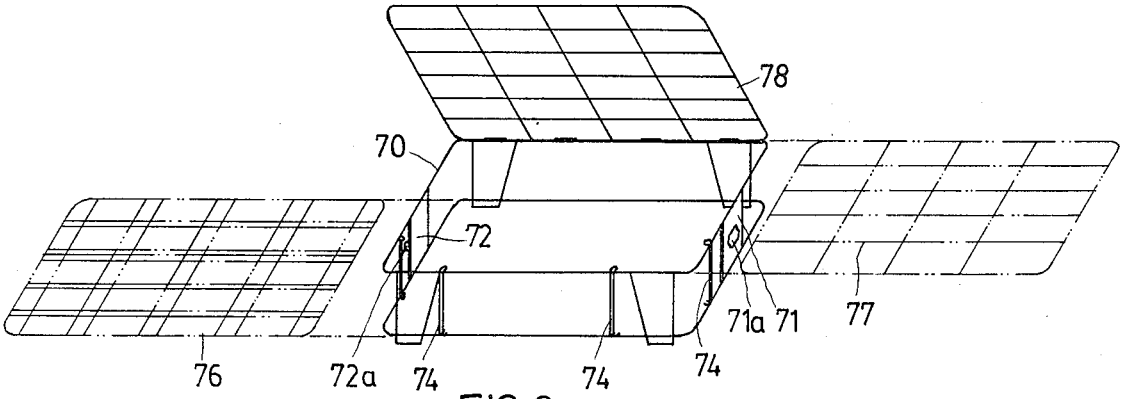
FIG. 9*a* is an exploded perspective view of the basket.

Now turning to FIG. 9 there is shown a sectional view of the transmission gear sets in which a transmission gear 20 is mounted on one end of a shaft 18 extruding through a bearing bracket 17 having a bearing 16 therein into the washing compartment 105. The bearing bracket 17 is provided on a wall of the washing compartment 105. The other end 18*a* of the shaft 18 located within the washing compartment 105 is made in a polygonal shape, and preferrably in a hexagonal shape. To seal the bearing 16, a waterproof cover 19 is provided on the bearing bracket 17. The hexagonal end 18*a* of the shaft 18 extrudes out of the cover 19.

Figure 4:
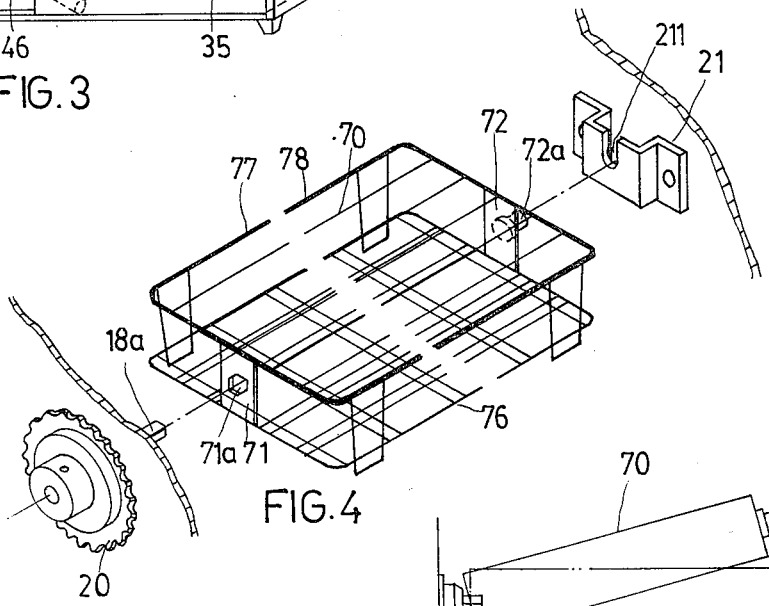
FIG. 4 is a partial exploded perspective view of a washing compartment with a basket.
Figure 5:
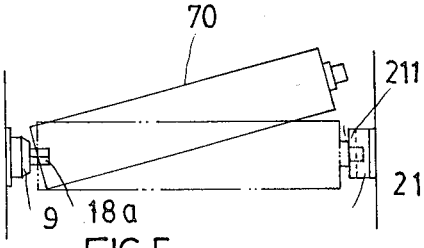
FIG. 5 is a schematic illustration showing the engaging relationship between the washing compartment and the basket.

As shown in FIG. 4, provided on a wall of the washing compartment 105, and placed opposite to the wall on which the bearing bracket 17 is mounted is a supporting bracket 21 having a recess 211 thereon. A basket 70 as shown has a network cover 78, an upper supporting network 77 and a lower supporting network 76. On a pair of opposed supporting plates 71, 72 mounted on the basket 70 are provided separately with a polygonal opening 71*a* and a round protruding stem 72*a* so as to engage with the polygonal end 18*a* of the shaft 18 and the recess 211 of the supporting bracket 21 respectively. The supporting plates 71, 72 are positioned on the middle portion of a pair of opposed sides of the basket 70. When the basket 70 is positioned in the washing compartnent 105 the axis of the shaft 18 is aligned with that of the round protruding stem 72*a* so that the basket 70 may be turned around by the rotation of the shaft 18. As best shown in FIG. 5, to place the basket 70 into the washing compartment 105, the polygonal opening 71*a* of the basket 70 is firstly engaged with the polygonal end 18*a* of the shaft 18, and then, the other side of the basket 70 is lowered to allow the round protruding stem 72*a* entering the recess 211 of the supporting bracket 21; and vice versa. Under such situation, the basket 70 is held firmly in the washing compartment 105.

Figure 3:
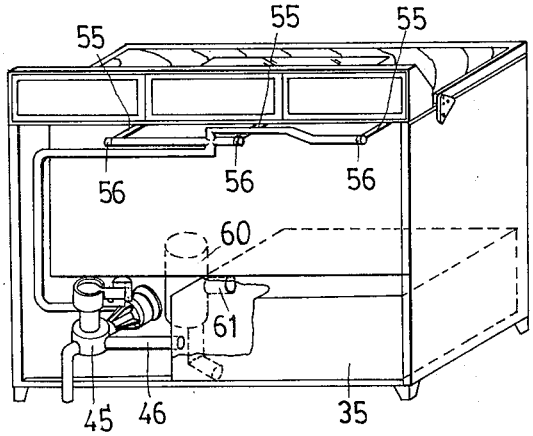
FIG. 3 is a partial exploded perspective view of said embodiment illustrating the pipe line provided therein.
Figure 6:
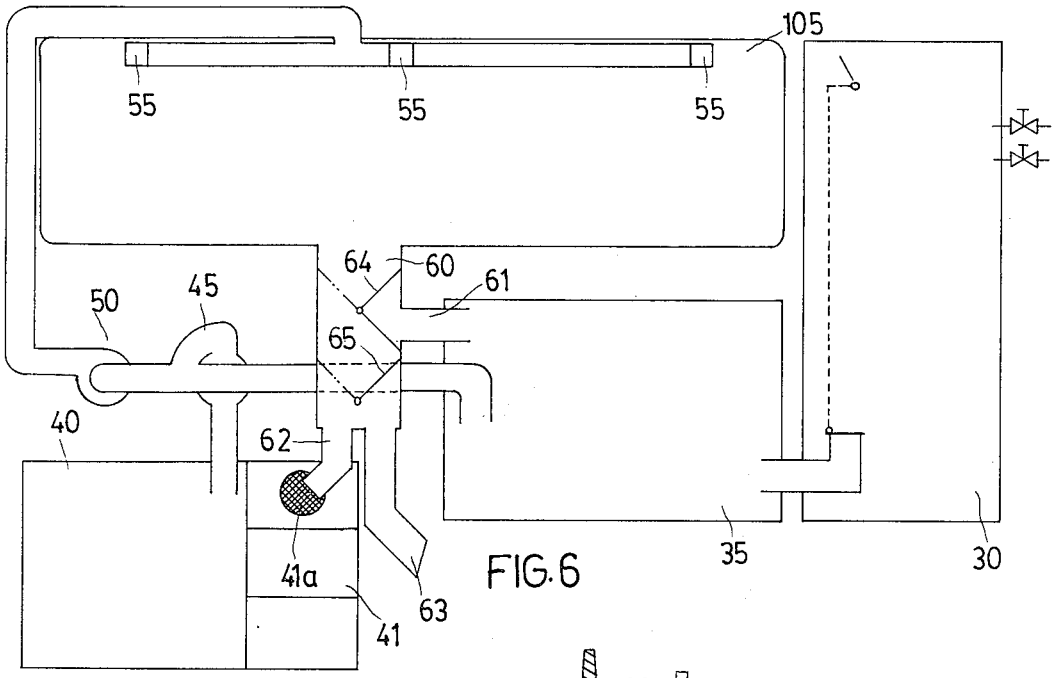
FIG. 6 is a flow diagram of the pipe line of said embodiment.

Referring to FIGS. 3 and 6, there is shown a rinsing system of the embodiment comprising a main tank 30 located outside the casing body 100 for storing water, a second water tank 35 positioned on the lower portion of the casing body 100, a third tank 40 located outside the casing body for storing rinsing liquid, a first controlling valve 45, a pump 50, injection pipes 55 and a second controlling valve 60.

The lower portion of the second tank 35 communicates through a pipe with the main tank 30. The function of the main tank is to supply sufficient water to the second tank 35. Provided between the pump 50 and the second tank 35 is the first contronlling valve 45 for controlling the communication between the second tank and the pump.

The second tank 35 communicates with the washing compartment 105, through a pipe, and an outlet 61 of the second controlling valve, so that the second controlling valve 60 can determine whether the water stored in the washing compartment should be discharged into the second tank 35 or not. A pipe provided on the third tank 40 is connected to the another inlet of the first controlling valve 45 so as to control the flowing of the rinsing liquid stored in the third tank into the pump 50. The third tank 40 is provided with a depositing chamber 41 having an opening with filter 41*a* thereon. The opening of the depositing chamber 41 is connected through another outlet 62 of the second controlling valve 60 to the washing compartment 105 and controlled by the seond controlling valve 60.

The pressurized water flowing through the pump 50 to the injection pipe 55 will be injected out of a plurality of fine openings provided on the injection pipes 55. The injection pipes 55 are mounted within the washing compartment 105.

Figure 7:
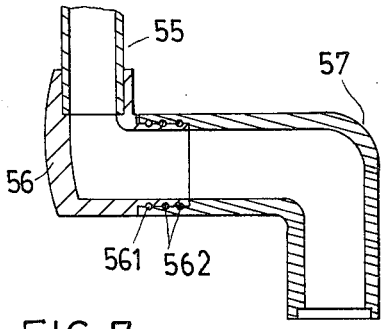
FIG. 7 is a partial sectional view of an injection pipe, a turnable device and a transmission pipe when assembled.

FIG. 7 shows a partial sectional view of the injection pipe 55 with a rotatable device 56 mounted on a transmission pipe 57. Provided on the device 56 are three annular grooves corresponding to three annular grooves provided on the inner surface of one end of the transmission pipe 57. By placing a number of steel balls 561 into the outermost corresponding groove of the device 56 and of the transmission pipe 57 to engage the device 55 with the injection pipe 55, the injection pipe 55 mounted on the device 56 can be rotated around the transmission pipe 57. To prevent the water or rinsing liquid leakaging from the engaging protion, two annular seal rings 562 are placed into the other two pairs of corresponding grooves of the device 56 and of the pipe 57.

The second controlling valve 60 is positioned on the lower portion of the washing compartment 105 and has three discharging outlets 61, 62 and 63 for connecting with the second tank 35, the third tank 40 and a discharging pipe (not shown) respectively. Two movable blades 64, 65 mounted in the second controlling valve 60 are used to control the closing of the outlets 61, 62 and 63 so as to control the discharging of the water stored within the washing compartment 105 out of one of the outlets.

FIGS. 10*a* to 14 show different embodiments of the basket in accordance with the invention, in which the lower supporting network 76 can be positioned horizontally on either the botton of the basket or on the middle portion of the basket depending on the kind of the goods to be held in the basket (as shown in FIGS. 11*a* and 10*a*). The upper and lower supporting networks 77, 76 are designed to position the goods placed in the basket. For various needs, the openings of the networks may be made in different sizes so as to hold different goods. A number of hook members 74 are used to lock the top cover 78 of the basket when the goods are positioned in the basket. Such that when the basket is rotated clockwisely or counterclockwisely by the transmission gear set 15*a*, the goods placed therein will not remove therefrom.

In operation, one may put the dirty dishes or the like into the basket, and turn the injection pipes 55 upwards so as to allow the basket to be put into the washing compartment 105. Then, turn the injection pipes to their original position and close the cover 101 of the casing body 100. Finally, set one minute for flushing operation to make the water stored in the second tank inject onto the dishes placed in the basket, three miuntes for rinsing operation to make the rinsing liquid stored in the third tank inject onto the dishes, and one minute for cleaning operation to make the water stored in the second tank inject again onto the dishes; and turn on simulataneously the driving motor 10 to rotate the basket in a clokwise or counterclockwise direction.

Since the electrical controlling circuits are known skills in the art not being characteristics of the invention, they are not described in the specification.

The features and objects of the present invention have been described hereinbefore for illustration purpose only and it is intended that scope of the invention be defined in the appending claims.

The injected water or rinsing liquid may be guided into the second tank or the third tank for re-use by the second controlling valve.

What is claimed is:

1. An apparatus for washing dishes and other small items comprising:

a casing body;

a washing compartment provided in said casing body;

driving means mounted within said casing body;

replaceable means rotatably supported in said washing compartment for receiving articles to be washed;

transmission means engaged with said driving means for rotating said replaceable means;

means for storing water and rinsing liquid;

turnable injection pipes mounted on the upper portion of said washing compartment and connected with said storing means; and means for pressuring the water or the rinsing liquid stored in said storing means to be injected out of said injection pipes onto the articles placed in said replaceable means.

2. An apparatus as claimed in claim 1 wherein said transmission means consists essentially of a gear set, a bearing device mounted on an inner wall of said washing compartment with a seal cover, and a transmission shaft extruding through the gear set, the bearing device and the seal cover into said washing compartment.

3. An apparatus as claimed in claim 2 wherein the inner end of said transmission shaft is made in a polygonal shape.

4. An apparatus as claimed in claim 2 wherein on a further inner wall of said washing compartment is provided with a supporting device having a U-shaped recess thereon for supporting one side of said repalceable means.

5. An apparatus as claimed in claim 4 wherein the U-shaped recess of said supporting device is opposed to the polygonal end of said transmission shaft.

6. An apparatus as claimed in claim 1 wherein said replaceable means is preferrably a rectangular basket consisting essentially of a frame, a network cover pivoted on the frame, a movable upper supporting network and a movable lower supporting network for positioning the articles, and a plurality of hook members for locking the supporting networks with the cover.

7. An apparatus as claimed in claim 6 wherein two supporting plates are provided on the middle part of a pair of opposed sides of said basket respectively, one of said supporting plates being provided with a polygonal opening thereon for receiving the polygonal end of said transmission shaft, the other supporting plate being provided with a round protruding stem thereon to be put into the U-shaped recess of said supporting device.

8. An apparatus as claimed in claim 1 wherein said storing means comprises a first tank placed outside said casing body and connected to the water source, a second tank mounted in said casing body and communicated with the first tank, and a third tank placed outside said casing body for storing rinsing liquid.

9. An apparatus as claimed in claim 8 wherein said washing compartment is provided with a three-way valve to control the flowing of the water or the rinsing liquid therein into the second tank or the third tank for re-use, or into a discharging pipe.

10. An apparatus as claimed in claim 9 wherein the third tank is provided with a depositing chamber having an opening with a filter, the opening being connected to an outlet of the three-way valve.

* * * * *